United States Patent [19]

Borggrefe et al.

[11] Patent Number: 4,957,641

[45] Date of Patent: Sep. 18, 1990

[54] USE OF ALKOXYHYDROXY FATTY ACIDS AS CORROSION INHIBITORS IN OILS AND OIL - CONTAINING EMULSIONS

[75] Inventors: Gerhard Borggrefe, Duesseldorf; Alfred Meffert, Monheim; Bert Gruber, Duesseldorf; Karl-Heinz Schmid, Mettmann, all of Fed. Rep. of Germany

[73] Assignee: Henkel Kommanditgesellschaft auf Aktien, Duesseldorf, Fed. Rep. of Germany

[21] Appl. No.: 919,098

[22] Filed: Oct. 15, 1986

[30] Foreign Application Priority Data

Nov. 13, 1985 [DE] Fed. Rep. of Germany ..... 3540246

[51] Int. Cl.[5] ..... C10M 129/04; C10M 129/26

[52] U.S. Cl. ..... 252/34; 252/49.5; 252/56 R; 252/390; 252/392; 252/396

[58] Field of Search ..... 252/390, 392, 396, 56 R, 252/34, 49.5

[56] References Cited

U.S. PATENT DOCUMENTS

| | | | |
|---|---|---|---|
| 2,564,422 | 8/1951 | Barnum | 252/34 |
| 2,956,067 | 10/1960 | DeGroote et al. | 44/66 |
| 3,066,159 | 11/1962 | DeGroote et al. | 260/413 Q |
| 3,119,848 | 1/1964 | Wrigley et al. | 260/404 |
| 3,556,994 | 1/1971 | Diery et al. | 252/33.6 |
| 3,696,048 | 9/1972 | Hausler et al. | 252/390 |
| 3,897,469 | 7/1975 | Stein et al. | 260/413 Q |
| 4,207,285 | 6/1980 | Oppenlaender et al. | 422/16 |
| 4,315,825 | 2/1982 | Schweizer et al. | 252/41 |
| 4,719,084 | 1/1988 | Schmid et al. | 252/34 |

FOREIGN PATENT DOCUMENTS

| | | |
|---|---|---|
| 0127132 | 12/1984 | European Pat. Off. . |
| 2943963 | 5/1981 | Fed. Rep. of Germany . |
| 3318596 | 11/1984 | Fed. Rep. of Germany . |

*Primary Examiner*—William R. Dixon, Jr.
*Assistant Examiner*—Jerry D. Johnson
*Attorney, Agent, or Firm*—Ernest G. Szoke; Wayne C. Jaeschke; Real J. Grandmaison

[57] ABSTRACT

The invention relates to the use of alkoxyhydroxy fatty acids and the salts thereof having the general formula (I)

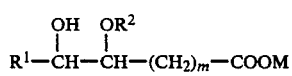

$$R^1-\underset{}{\overset{OH}{\overset{|}{CH}}}-\overset{OR^2}{\overset{|}{CH}}-(CH_2)_m-COOM \quad (I)$$

wherein $R^1$ represents a straight chain alkyl radical or a straight chain alkenyl radical having from 6 to 8 carbon atoms, $R^2$ represents a straight chain or branched chain alkyl radical having from 1 to 18 carbon atoms, or a straight chain or branched chain alkenyl radical having from 2 to 18 carbon atoms, M represents hydrogen or an organic ammonium radical having one or more alkyl radicals or hydroxy alkyl radical attached to the nitrogen atom, and m represents an integer having a value of from 3 to 13, in an amount of from 0.01 to 10% by weight, based on the weight of oil, as corrosion inhibitors in oils and oil-containing emulsions.

10 Claims, No Drawings

USE OF ALKOXYHYDROXY FATTY ACIDS AS CORROSION INHIBITORS IN OILS AND OIL - CONTAINING EMULSIONS

BACKGROUND OF THE INVENTION

1. Field of the Invention

This invention relates to corrosion inhibitors, and more particularly, to the use of alkoxyhydroxy fatty acids as corrosion inhibitors in oils and oil-containing emulsions.

In industrial processes of mechanical working and cleaning of metal surfaces, as well as in industrial cooling systems, oils and oil-containing emulsions occasionally come into contact with the metal surfaces at high temperatures wherein the liquid media contains substantial amounts of water. The source of water may result in part from the aforementioned processes where it was a desired component. However, in all of these cases where the metal surfaces come into contact with a liquid media containing water, such creates a considerable problem with respect to corrosion protection of the metal surfaces. This is particularly a problem with metal surfaces comprising iron or iron-containing alloys which are easily corroded by water or moisture present on the metal surfaces. The result is a reduction in the useful life of the metal surfaces, or, if the metal surfaces are to be further processed, for example by the application thereto of a phosphate coating, galvanized coating, varnish coating, etc., such requires that the metal surfaces be recleaned as a preparatory step therefor. Thus, to inhibit or suppress, corrosion in the aforementioned cases, a corrosion inhibitor is added during the metal treatment processes of working and cleaning, and in cooling systems.

2. Discussion of Related Art

German Published Application No. 11 49 843 discloses amine salts of amidoacids obtained by reacting succinic anhydride or maleic anhydride with primary alkylamines, where the alkyl group contains from 4 to 30 carbon atoms, and then neutralizing the product with such amines, as lubricant additives and fuel additives having an anti-rust effect. The aforementioned materials are, however, oil-soluble and generally are not water-soluble. Where they are water-soluble, it has been found that they either foam much too heavily, or if they have a low tendency to foam, they lose a substantial part of their anti-corrosion effect.

U.S. Pat. No. 4,207,285 discloses a process for preventing the corrosion of metals in aqueous systems by employing alkanolamine salts of maleamic acids as anti-corrosion agents. This patent teaches that if the chain length of the isoalkyl radical is from 6 to 8 carbon atoms, the anti-corrosion agents obtain lower foaming properties, are water-soluble, and retain their anti-corrosion properties.

In addition, U.S. Pat. No. 3,556,944 discloses alkali or amine salts of aromatic sulphonamido carboxylic acids as agents in aqueous metal-working liquids or water-containing oil emulsions, have corrosion inhibiting activity, and are water-soluble or water-dispersible. However, these compounds have the drawback that they are generally regarded as relatively toxic and, thus, the use thereof is subject to rigid restrictions.

Further, in German Application No. 29 43 963 there are disclosed alkanolamine salts of alkenyl succinic acids which exhibit good protection from corrosion of metal surfaces made of iron or iron-containing alloys in aqueous systems without suffering from a tendency to foam. In addition, European Application No. 0 127 132 relates to alkenyl succinic acid semiamides as anticorrosive agents which are also employed in aqueous process liquids for drilling, cutting or rolling, respectively, of metals. However, in aqueous media sometimes hydrolysis of said succinic acid derivatives is observed which drastically reduces the corrosioninhibiting effect of such compounds. In addition, the starting materials as required for the preparation of such compounds are only available after fairly expensive synthesis, so there appears to be a need to find new anticorrosive agents which not only are universally applicable but also do not have the disadvantages as described herein, such as foaming tendency, instability to hydrolysis, toxicity, incompatibility with hard process water, and the like.

3. Description of the Invention

It has surprisingly been found that ringopening products of epoxy fatty acids with straight chain or branched chain alcohols and the salts thereof are well suitable as corrosion inhibitors in mineral oils and emulsions containing mineral oil. The present invention relates to the use of alkoxyhydroxy fatty acids and the salts thereof having the general formula (I)

$$R^1-\underset{}{\overset{OH}{\overset{|}{CH}}}-\overset{OR^2}{\overset{|}{CH}}-(CH_2)_m-COOM \qquad (I)$$

wherein $R^1$ represents a straight chain alkyl radical or a straight chain alkenyl radical having from 6 to 8 carbon atoms, $R^2$ represents a straight chain or branched chain alkyl radical having from 1 to 18 carbon atoms, or a straight chain or branched chain alkenyl radical having from 2 to 18 carbon atoms, M represents hydrogen or an organic ammonium radical having one or more alkyl radicals or hydroxyalkyl radicals attached to the nitrogen atom, and m represents an integer having a value of from 3 to 13, preferably from 7 to 11.

The afore-described alkoxyhydroxy fatty acids and the salts thereof are used as corrosion inhibitors in oils and oil-containing emulsions in an amount of from about 0.01 to about 10% by weight, based on the weight of the oil.

Other than in the operating examples, or where otherwise indicated, all numbers expressing quantities of ingredients or reaction conditions used herein are to be understood as modified in all instances by the term "about."

The compounds having the general formula (I) given above are known per se. The process for preparing said compounds is described, for example, in German Application No. 33 18 596. In accordance therewith, alkoxyhydroxy fatty acids and the salts thereof having the general formula (I) are formed by epoxidizing fatty acids or the esters thereof having the general formula (II)

$$R^1-CH=CH-(CH_2)_m-COOM \qquad (II)$$

wherein $R^1$ and m are as defined above, and M represents hydrogen or an alkyl group, preferably one of alcohols as occuring in natural fats or oils in an esterified state, in accordance with known processes. Such an epoxidation reaction, for example, can be effected by the reaction of the fatty acids or the esters thereof having the general formula (II) with organic peroxo acids under suitable conditions. The thus obtained epoxides having the oxyran ring at that position in the molecule at which in the starting materials the olefinic double bond had been located, then are converted into the corresponding alkoxyhydroxy fatty acid derivatives in accordance with also known procedures by means of an acid-catalyzed ring opening with alcohols having the general formula $$R^2OH \qquad (III)$$

wherein $R^2$ may be as defined above. In said alkoxyhydroxy fatty acid derivatives, the alkoxy group $R^2O$ and the hydroxy group are attached to the two carbon atoms as connected by the olefinic double bond in the starting material. Depending on the employed amount of alcohol, the terminal ester group of the epoxide may also be trans-esterified.

The esters resulting from said reaction sequence are then subjected to alkaline saponification in accordance with also known methods whereby the salts having the general formula (I) are formed wherein M represents an organic ammonium radical having one or more alkyl radicals or hydroxyalkyl radicals attached to the nitrogen atom. The corresponding salts may optionally be converted to the respective acids wherein M represents hydrogen, by adjusting an acidic pH value in the reaction medium.

It is preferred for such reaction sequences to employ naturally occurring fats and oils having the general formula (II) which are available from natural sources at large scale and reasonable price. Preferably used are soybean oil having a high content of oleic acid and linoleic acid, sunflower oil, sesame oil, corn oil, cotton seed oil, palm oil or coconut oil. Such natural fats and oils contain high amounts of esters of unsaturated fatty acids having the general formula (I) wherein $R^1$ represents straight chain alkyl radicals or straight chain alkenyl radicals, for example, those having 8 carbon atoms. Occasionally, in such oils of natural origin there are also present mixtures of esters having different chain lengths; for example, in soybean oil there are found mixtures of fatty acid esters having the general formula (II) wherein $R^1$ represents alkyl and alkenyl radicals having 8 carbon atoms, the saturated and unsaturated portions being in a ratio by weight to each other of 1:2. Such compounds are to be considered as preferred for use in the present invention.

The alcohols having the general formula (III) as used for the alcoholysis of the oxyran ring contains straight chain or branched chain alkyl radicals having from 1 to 18 carbon atoms or straight chain or branched chain alkenyl radicals having from 2 to 18 carbon atoms. However, straight chain alkyl radicals or straight chain alkenyl radicals having from 8 to 18 carbon atoms are preferred, as they are available from natural sources in large amounts at low price. More preferably, alcohol mixtures of natural origin are employed which contain straight chain alkyl radicals having 16 carbon atoms and straight chain alkenyl radicals having 18 carbon atoms. These, for example, are mixtures comprising cetyl alcohol and oleyl alcohol, and reaction products of said alcohol mixtures with epoxidized fatty acids of natural origin result in alkoxyhydroxy fatty acids which may be used as being particularly preferred within the scope of the present invention.

According to the invention as corrosion inhibitors, there are usable not only the free alkoxyhydroxy fatty acids (I), wherein M represents hydrogen, but also the oil-soluble salts (I) thereof, wherein M represents an organic ammonium radical having one or more alkyl radicals or hydroxyalkyl radicals attached to the nitrogen atom. Preferred cations of salts are ammonium cations which bear two or three alkylradicals or hydroxyalkyl radicals at the nitrogen atom. Of these, particularly preferred is the salt (I) wherein M represents a diethanolammonium radical.

The alkoxyhydroxy fatty acids and the salts thereof of the general formula (I) as indicated may be employed in lubricant oils, lubricant greases, power transmission oils and metal-working emulsions based on mineral oil as corrosion inhibitors. They are used in wide ranges of amounts in oils or oil-containing emulsions. The amounts may vary within a range of from about 0.01 to about 10% by weight, based on the weight of the oil, and preferably at from about 0.05 to about 0.5% weight. Oils and oil-containing emulsions which contain alkoxyhydroxy fatty acids or the salts thereof having the general formula (I) in said amounts, exhibit a protection from corrosion of iron and iron-containing metal surfaces which is at least equivalent to that of known compounds. Said alkoxyhydroxy fatty acids and the salts thereof are superior to previously known compounds in that they can be made available from natural raw materials in large amounts and at low price.

The present invention is further illustrated by the following examples.

For use according to the invention the compounds listed in the following Table 1 were prepared according to the above-described procedure; the solubility in oils of different characters of said compounds is also indicated in Table 1.

TABLE 1

Tested compounds having the general formula (I)

| Compound No. | $R^1$ | $R^2$ | $M^1$ | m | oil solubility[3] 50% by wt. (a) | (b) |
|---|---|---|---|---|---|---|
| 1 | $C_8H_{17}$ | $CH_3$ | H | 7 | + | − |
| 2 | $C_8H_{17}$ | n-$C_6H_{13}$ | H | 7 | + | + |
| 3 | $C_8H_{17}$ | n-$C_6H_{13}$ | DEA | 7 | + | − |
| 4 | $C_8H_{17}$ | n-$C_8H_{17}$ | H | 7 | + | + |
| 5 | $C_8H_{17}$ | n-$C_8H_{17}$ | DEA | 7 | + | + |
| 6 | $C_8H_{17}$ | n-$C_{12}H_{25}$ | H | 7 | + | + |
| 7 | $C_8H_{17}$ | n-$C_{12}H_{25}$ | DEA | 7 | + | + |
| 8 | $C_8H_{17}$ | n-$C_{16}H_{33}$ | H | 7 | + | + |
| 9 | $C_8H_{17}$ | n-$C_{16}H_{33}$ | DEA | 7 | + | + |
| 10 | $C_8H_{17}$ | n-$C_{16/18}H_{33}$[2]/35 | H | 7 | + | + |
| 11 | $C_8H_{17}$ | n-$C_{16/18}H_{33/35}$ | DEA | 7 | + | + |
| 12 | $C_8H_{17}$ | $C_4H_9-\underset{\underset{C_2H_5}{\vert}}{CH}-CH_2$ | H | 7 | + | + |
| 13 | $C_8H_{17}$ | $C_4H_9-\underset{\underset{C_2H_5}{\vert}}{CH}-CH_2$ | DEA | 7 | + | − |
| 14 | $C_8H_{15/17}$[4] | $CH_3$ | H | 7 | − | − |
| 15 | $C_8H_{15/17}$ | n-$C_{16/18}H_{33/35}$[2] | H | 7 | − | − |
| 16 | $C_8H_{15/17}$ | n-$C_{16/18}H_{33/35}$[2] | DEA | 7 | + | + |
| 17 | $C_8H_{15/17}$ | n-$C_8H_{17}$ | H | 7 | + | − |
| 18 | $C_8H_{15/17}$ | n-$C_8H_{17}$ | DEA | 7 | + | − |
| 19 | $C_8H_{15/17}$ | n-$C_{12}H_{25}$ | H | 7 | + | + |

TABLE 1-continued

| Compound No. | $R^1$ | $R^2$ | $M^1$ | m | oil solubility[3] 50% by wt. (a) | (b) |
|---|---|---|---|---|---|---|
| | Tested compounds having the general formula (I) | | | | | |
| 20 | $C_8H_{15/17}$ | n-$C_{12}H_{25}$ | DEA | 7 | + | − |

Notes:
[1]DEA = diethanol ammonium
[2]1:1 cetylalkoxy/oleylalkoxy (iodine value 50–55) (Ocenol ® 50/55)
[3]oil solubility:
+ = soluble
− = sparingly soluble
[a]napthenic oil (Pionier ® 4556)
[b]paraffinic oil (Enerpar ® 13)
[4]1:2 n-octyl/n-oct-2-enyl (from soybean oil)

EXAMPLE 1

Degreased and abraded steel rods (material: CK15 according to DIN 17 210) were stored for 24 hours in agitated mixtures comprising mineral oil and water in the ratio of 10 : 1 (process A) or mineral oil and artificial seawater (ratio 10 : 1) (process B) according to DIN 51 585 at 60° C. Upon expiration of the prescribed duration of the test, the test specimens were evaluated for corrosion phenomena. The evaluation was made in accordance with the following standard:

0: no corrosion;
1: traces of corrosion;
2: slight corrosion (corroded area less than 5%);
3: moderate corrosion (corroded area within the range of from 5 to 20%), and
4: heavy corrosion (corroded area more than 20%).

The results are set forth in the following Tables 2 and 3.

COMPARATIVE EXAMPLES 1 AND 2

For comparison under the conditions as set forth in Example 1, identical test specimens were stored in solutions containing no inhibitor (Comp. 1) or in the respective mixtures containing a commercially available alkenylsuccinic acid semiester the concentration of which corresponded to that of the alkoxyhydroxy fatty acids used according to the invention (Comp. 2). The results are set forth in the following Tables 2 and 3.

TABLE 2

Corrosion test results using compounds of Table 1 according to DIN 51 585 in (A) mineral oil-distilled water mixtures and (B) mineral oil-sea water mixtures. Oil: naphthenic (Pionier ® 4556)

| Compound No. | Test Process | Degree of corrosion at an inhibitor concentration of %/wt of oil 0.01 | 0.025 | 0.05 | 0.1 | 0.5 |
|---|---|---|---|---|---|---|
| 1 | A | 0 | 0 | 0 | 0 | 0 |
| | B | 3 | 0 | 0 | 0 | 0 |
| 2 | B | — | 1 | 0 | 1 | 0 |
| 3 | B | — | 0 | 0 | 0 | 0 |
| 4 | A | 2 | 1 | 0 | 0 | 0 |
| | B | 4 | 2 | 1 | 0 | 0 |
| 5 | A | 1 | 1 | 0 | 0 | 0 |
| | B | 4 | 4 | 3 | 0 | 0 |
| 6 | B | — | 2 | 2 | 1 | 0 |
| 7 | B | — | 2 | 1 | 1 | 0 |
| 8 | B | 4 | — | 2 | 1 | 1 |
| 9 | B | 4 | — | 3 | 1 | 1 |
| 10 | A | 0 | 0 | 0 | 0 | 0 |
| | B | 2 | 1 | 0 | 0 | 0 |
| 11 | A | 0 | 0 | 0 | 0 | 0 |
| | B | 4 | 4 | 3 | 2 | 0 |
| 12 | B | — | 1 | 1 | 0 | 0 |
| 13 | B | — | — | 2 | 1 | 0 |
| 16 | B | — | — | 4 | 4 | 0 |
| 17 | B | — | — | 1 | 1 | 0 |

TABLE 2-continued

Corrosion test results using compounds of Table 1 according to DIN 51 585 in (A) mineral oil-distilled water mixtures and (B) mineral oil-sea water mixtures. Oil: naphthenic (Pionier ® 4556)

| Compound No. | Test Process | Degree of corrosion at an inhibitor concentration of %/wt of oil 0.01 | 0.025 | 0.05 | 0.1 | 0.5 |
|---|---|---|---|---|---|---|
| 18 | B | — | — | 1 | 0 | 0 |
| 19 | B | — | — | 1 | 1 | 1 |
| 20 | B | — | — | 1 | 0 | 0 |
| Comp. 1 | A/B | | | 4 | | |
| Comp. 2 | A | 0 | 0 | 0 | 0 | 0 |
| | B | 4 | 0 | 0 | 0 | 0 |

TABLE 3

Corrosion test results using compounds of Table 1 according to DIN 51 585 in (A) mineral oil-distilled water mixtures and (B) mineral oil-sea water mixtures. Oil: paraffinic (Enerpar ® 13)

| Compound No. | Test Process | Degree of corrosion at an inhibitor concentration of (%)/wt of oil 0.01 | 0.025 | 0.05 | 0.1 | 0.5 |
|---|---|---|---|---|---|---|
| 1 | A | 4 | — | 0 | 0 | 0 |
| | B | 4 | 4 | 4 | 3 | 0 |
| 2 | B | — | 2 | 2 | 2 | 2 |
| 4 | A | 4 | — | 0 | 0 | 0 |
| 4 | B | 4 | — | 2 | 2 | 1 |
| 5 | A | 1 | 1 | 0 | 0 | 0 |
| 5 | B | 4 | 4 | 3 | 0 | 0 |
| 6 | B | — | 3 | 1 | 1 | 1 |
| 7 | B | — | 3 | 2 | 1 | 0 |
| 8 | B | — | — | 2 | 0 | 0 |
| 9 | B | — | — | 3 | 0 | 0 |
| 10 | A | 4 | — | 1 | 0 | 0 |
| 10 | B | 4 | — | 3 | 0 | 0 |
| 11 | A | 1 | — | 0 | 0 | 0 |
| 11 | B | 4 | — | 2 | 1 | 0 |
| 12 | B | — | — | 2 | 3 | 3 |
| 16 | B | — | — | — | 3 | 1 |
| Comp. 1 | A/B | | 4 | | | |

EXAMPLE 2

This test was conducted according to DIN 51360, part 2, using grey cast iron filter paper.

In this test procedure, grey cast iron files were wetted with an oil emulsion in chloride-loaded or hardness-loaded water, respectively, on a round filter paper wherein the emulsion had been prepared with the use according to the invention of alkoxyhydroxy fatty acids or the salts thereof having the general formula (I). After a 2 hour test period at room temperature, the corrosion images on the filter paper were visually evaluated in accordance with the procedure indicated in the standard.

The emulsions were prepared from the corresponding concentration in accordance with conventional methods using water having a total hardness of 3.58 mmol of $CaCl_2 \cdot 6H_2O$ and $MgSO_4 \cdot 7H_2O$.

The employed mixtures were prepared using the following concentrates:

| | |
|---|---|
| Recipe 1 | |
| naphthenic mineral oil: | 60% |
| emulsifier (adduct of 6.5 moles ethylene oxide to nonyl phenol): | 10% |
| solubilizer (diglycolmonobutyl ether): | 5% |
| and | |
| corrosion inhibitor (according to the invention): | 25% |
| Recipe 2 | |

-continued

| | |
|---|---|
| naphthenic mineral oil: | 50% |
| emulsifier (adduct of 6.5 moles ethylene oxide to nonyl phenol): | 10% |
| corrosion inhibitor (according to the invention): | 40% |

All percentages are percentages by weight.

The emulsions were prepared by adding with agitation from 8 to 25% by weight of the concentrates as indicated (Recipes 1 and 2, respectively) to water having the total hardness as indicated. This conforms to DIN 51360/part 2. The results are set forth in the following Table 4. Therein, the degree of corrosion was evaluated as follows:

0: no corrosion;
1: traces of corrosion;
2: slight corrosion (corroded area less than 1%);
3: moderate corrosion (corroded area within the range of from 1 to 5%), and
4: heavy corrosion (corroded area more than 5%).

COMPARATIVE EXAMPLE 3

Following the test procedure of Example 2, an emulsion was used which did not contain any inhibitor of the general formula (I). In said comparative emulsion the ratio of naphthenic mineral oil to emulsifier (adduct of 6.5 moles ethylene oxide to nonyl phenol) was 4:1. The results are also set forth in the following Table 4 (Comp. 3).

TABLE 4

Corrosion test results according to DIN 51360/part 2 using compounds according to Table 1 (grey cast iron file filter paper test)

| Compound No. | Recipe | Concentration (%) Concentrate | Concentration (%) Inhibitor | Degree of Corrosion |
|---|---|---|---|---|
| 3 | 1 | 8 | 2 | 0 |
| 7 | 1 | 8 | 2 | 1 |
| 9 | 1 | 8 | 2 | 1 |
| 13 | 1 | 8 | 2 | 0 |
| 18 | 1 | 8 | 2 | 0 |
| 20 | 1 | 8 | 2 | 0 |
| Comp. 3 | — | 8–20 | — | 4 |

EXAMPLE 3

A further test of the anti-corrosive property was carried out wherein abraded steel sheets (ST 1405) measuring 25 mm×50 mm were maintained in agitated mineral oil emulsions at an elevated temperature. Two respective rotating steel sheets having the same compositions, size and surface quality, were subjected to the action of a chloride-loaded and hardness-loaded mineral oil emulsion at 50° C. for three days, and upon expiration of the test period the mass loss was gravimetrically determined for both of the sheets and the average was calculated. The results were compared to the average weight loss of control samples in an inhibitor-free emulsion, and therefore the protection from corrosion S (in %) was calculated using the following equation:

$$S = \frac{G_O - G_I}{G_O} \times 100\ (\%)$$

wherein $G_0$ is the weight difference between the test sheet before and after the storage in an inhibitor-free emulsion and $G_I$ is the weight difference of the test sheet before and after the storage in an inhibitor-containing emulsion.

The results are set forth in the following Table 5.

COMPARATIVE EXAMPLE 4

Following the test procedure of Example 3, steel sheets were maintained under the same reaction conditions in a mineral oil emulsion containing no inhibitor. In said emulsion the ratio by weight of mineral oil to emulsifier was 4:1. The results are also set forth in Table 5 (Comp. 4).

TABLE 5

Corrosion test results using steel sheets of the quality ST 1405 and compounds according to Table 1 (mass reduction test).

| Compound No. | Recipe | Inhibitor (%) | Reduction in mass (mg) | Reduction in mass ($g/m^2$) | Protection from rust S (%) |
|---|---|---|---|---|---|
| 7 | 1 | 0.01 | 2.0 | 0.8 | 98.6 |
| | 1 | 0.05 | 0.75 | 0.3 | 99.5 |
| 9 | 1 | 0.01 | 1.8 | 0.7 | 98.9 |
| 18 | 1 | 0.01 | 1.1 | 0.4 | 99.3 |
| Comp. 4 | 1 | 0 | 144.5 | 57.8 | 0 |

EXAMPLE 4

In a further corrosion test, steel sheets (quality ST 1405, degreased and abraded, having dimensions of 25 mm ×50 mm) were immersed in mineral oil emulsions prepared by using the substances as employed according to the invention. Different amounts of inhibitor were used in the mineral oil emulsions. After a certain period of time allowing the liquid to drip off and the sheets to dry, the steel sheets were stored in a humidity chamber at 100% relative humidity. Upon expiration of the test period (from 1 to 7 days), the steel sheets were checked for corrosion phenomena. The evaluation was carried out in accordance with the standard evaluation grades ranging from 0 to 4 in accordance with that set forth in example 1. The results are set forth in the following Table 6.

COMPARATIVE EXAMPLE 5

Corresponding to the conditions as indicated in Example 4, identical steel sheets having the same size were stored in mineral oil emulsions which did not contain any inhibitor. The comparative emulsions contained naphthenic mineral oil and emulsifier (adduct of 6.5 moles ethylene oxide to nonyl phenol) in a ratio by weight of 4:1. The results of the comparative experiments are also set forth in the following Table 6 (Comp. 5).

TABLE 6

Corrosion test results using steel sheets of the quality ST 1405 (humidity test) employing compounds according to Table 1.

| Compound No. | Recipe | Concentrate (%) | Inhibitor (%) | Degree of corrosion after day(s) 1 | 5 | 7 |
|---|---|---|---|---|---|---|
| 2 | 2 | 25 | 10 | 0 | 0 | 0 |
| 3 | 1 | 20 | 5 | 0 | 1 | 1 |
| 6 | 2 | 25 | 10 | 0 | 0 | 0 |
| 7 | 1 | 20 | 5 | 0 | 0 | 1 |

TABLE 6-continued

Corrosion test results using steel sheets of the quality ST 1405 (humidity test) employing compounds according to Table 1.

| Compound No. | Recipe | Concentrate (%) | Inhibitor (%) | Degree of corrosion after day(s) 1 | 5 | 7 |
|---|---|---|---|---|---|---|
| 8 | 2 | 25 | 10 | 0 | 1 | 1 |
| 9 | 1 | 20 | 5 | 0 | 0 | 0 |
| 12 | 2 | 25 | 10 | 0 | 1 | 1 |
| 13 | 1 | 20 | 5 | 0 | 1 | 2 |
| 18 | 1 | 20 | 5 | 0 | 1 | 1 |
| 20 | 1 | 20 | 5 | 0 | 1 | 2 |
| Comp. 5 | — | 20 | 0 | 4 | — | — |

We claim:

1. A process for corrosion inhibition of a metal comprising contacting said metal with an oil or oil containing emulsion containing an effective amount to inhibit corrosion of an alkoxyhydroxy fatty acid or a salt thereof having the general formula (I)

$$R^1-\underset{}{\overset{OH}{\overset{|}{CH}}}-\overset{OR^2}{\overset{|}{CH}}-(CH_2)_m-COOM \qquad (I)$$

wherein $R^1$ represents a straight chain alkyl radical or a straight chain alkenyl radical having from 6 to 8 carbon atoms, $R^2$ represents a straight chain or branched chain alkyl radical having from 1 to 18 carbon atoms, or a straight chain or branched chain alkenyl radical having from 2 to 18 carbon atoms, M represents hydrogen or an organic ammonium radical having one or more alkyl radicals or hydroxyalkyl radicals attached to the nitrogen atom, and m represents an integer having a value of from 3 to 13, in an amount of from about 0.01 to about 10% by weight, based on the weight of said oil or said oil-containing emulsion.

2. A process according to claim 1 wherein $R^1$ is a straight chain alkyl radical or a straight chain alkenyl radical having 8 carbon atoms.

3. A process according to claim 1 wherein $R^1$ represents an alkyl radical or an alkenyl radical having 8 carbon atoms in a weight ratio of 1 : 2, respectively.

4. A process according to claim 1 wherein m represents an integer having a value of from 7 to 11.

5. A process according to claim 1 wherein $R^2$ represents a straight chain alkyl radical or a straight chain alkenyl radical having from 8 to 18 carbon atoms.

6. A process according to claim 1 wherein $R^2$ represents a straight chain alkyl radical having 16 carbon atoms or a straight chain alkenyl radical having 18 carbon atoms.

7. A process according to claim 1 wherein M represents hydrogen.

8. A process according to claim 1 wherein M represents a diethanolammonium radical.

9. A process according to claim 1 wherein the amount of compound having said general formula (I) is from about 0.05 to about 0.5% by weight, based on the weight of said oil or said oil-containing emulsion.

10. A process according to claim 1 wherein said oil or oil-containing emulsion is selected from the group consisting of a lubricant oil, lubricant grease, power transmission oil, or metal-working emulsion based on mineral oil.

* * * * *